US009609438B2

(12) United States Patent
Kim et al.

(10) Patent No.: US 9,609,438 B2
(45) Date of Patent: Mar. 28, 2017

(54) SPEAKER APPARATUS AND ELECTRONIC DEVICE HAVING THE SAME

(71) Applicant: Samsung Electronics Co., Ltd., Suwon-si, Gyeonggi-do (KR)

(72) Inventors: Kwang-Hyun Kim, Suwon-si (KR); Kyu-Eun Park, Suwon-si (KR); Brian S J Han, Seoul (KR); Young-Hun An, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/862,969

(22) Filed: Sep. 23, 2015

(65) Prior Publication Data

US 2016/0088398 A1 Mar. 24, 2016

(30) Foreign Application Priority Data

Sep. 24, 2014 (KR) ..... 10-2014-0127675

(51) Int. Cl.

| | |
|---|---|
| ***H04R 1/02*** | (2006.01) |
| ***H04R 9/06*** | (2006.01) |
| ***H04R 9/02*** | (2006.01) |
| ***H04R 7/18*** | (2006.01) |
| *H04R 1/28* | (2006.01) |
| *H04R 1/32* | (2006.01) |
| *H04R 31/00* | (2006.01) |

(52) U.S. Cl.

CPC ..... *H04R 9/06* (2013.01); *H04R 1/02* (2013.01); *H04R 7/18* (2013.01); *H04R 9/025* (2013.01); *H04R 1/2811* (2013.01); *H04R 1/323* (2013.01); *H04R 31/003* (2013.01); *H04R 2499/11* (2013.01)

(58) Field of Classification Search

CPC ..... H04R 1/02; H04R 1/025; H04R 1/026; H04R 9/00

USPC ..... 381/386, 396, 398

See application file for complete search history.

(56) References Cited

U.S. PATENT DOCUMENTS

| | | | | |
|---|---|---|---|---|
| 2,442,791 A * | 6/1948 | Wente | ..... | H04R 7/20 181/172 |
| 6,804,365 B2 * | 10/2004 | Ohira | ..... | H04R 1/025 381/386 |
| 7,275,620 B1 * | 10/2007 | Diedrich | ..... | H04R 7/16 181/171 |
| 8,126,185 B1 * | 2/2012 | Dai | ..... | H04R 7/18 381/386 |

(Continued)

FOREIGN PATENT DOCUMENTS

| | | |
|---|---|---|
| EP | 1315400 A2 | 5/2003 |
| EP | 2194729 A1 | 6/2010 |

(Continued)

*Primary Examiner* — Suhan Ni

(74) *Attorney, Agent, or Firm* — Jefferson IP Law, LLP

(57) ABSTRACT

A speaker apparatus and an electronic device having the same are provided. The speaker apparatus includes a hollow shape frame, a magnet disposed in an internal part of the hollow shape frame, a voice coil installed in proximity to the magnet, a diaphragm including a diaphragm edge that vibrates by an electric current applied to the voice coil, and a diaphragm edge compression part extended upward along the diaphragm edge. The diaphragm edge compression part contacts an inner surface of a housing of the electronic device.

20 Claims, 19 Drawing Sheets

(56) References Cited

U.S. PATENT DOCUMENTS

| | | | | |
|---|---|---|---|---|
| 9,271,082 | B2 * | 2/2016 | Oclee-Brown | H04R 7/20 |
| 2005/0190941 | A1 | 9/2005 | Yang | |
| 2009/0290744 | A1 | 11/2009 | Wu et al. | |
| 2011/0274308 | A1 | 11/2011 | Doh et al. | |
| 2011/0293131 | A1 | 12/2011 | Kobayashi et al. | |
| 2011/0317868 | A1 | 12/2011 | Tsujii | |
| 2012/0082327 | A1 | 4/2012 | Matsuo | |
| 2012/0237076 | A1 | 9/2012 | Kuze | |

FOREIGN PATENT DOCUMENTS

| | | | |
|---|---|---|---|
| JP | 2004159181 | A | 6/2004 |
| JP | 2005073103 | A | 3/2005 |
| KR | 10-2010-0138152 | A | 12/2010 |

* cited by examiner

SPEAKER APPARATUS AND ELECTRONIC DEVICE HAVING THE SAME

CROSS-REFERENCE TO RELATED APPLICATION(S)

This application claims the benefit under 35 U.S.C. §119 (a) of a Korean patent application filed on Sep. 24, 2014 in the Korean Intellectual Property Office and assigned Serial number 10-2014-0127675, the entire disclosure of which is hereby incorporated by reference.

TECHNICAL FIELD

The present disclosure relates to an electronic device. More particularly, the present disclosure relates to an electronic device including a speaker apparatus.

BACKGROUND

To satisfy various desires of consumers, electronic devices such as smart phones and tablet personal computers (PCs) are being launched and spread to modern society in the direction of strengthening customer services for various multimedia such as a voice, a video, etc. in addition to a basic function of telephony, etc. Because a speaker apparatus is essential to these various multimedia services, a device manufacturer is endeavoring to develop a high-output speaker apparatus at low cost under the same condition.

The above information is presented as background information only to assist with an understanding of the present disclosure. No determination has been made, and no assertion is made, as to whether any of the above might be applicable as prior art with regard to the present disclosure.

SUMMARY

To apply a sound leakage prevention structure to a speaker front radiation part, the speaker apparatus of the related art uses an additional front member that consists of a separate rubber or cushion, etc. This causes an increase in assembly time and, together with this, results in an increase of a material cost and a manufacturing process cost according to the addition of a separate member. Also, because a worker attaches the front member in a manual fashion at a front member attachment, it is not easy to attach the front member to an exact position. Accordingly, an attachment position of the front member becomes different and thus, sound leakage occurs. The front member interrupts sound radiation, causing sound volume decrease, sound distortion, etc. Further, a space of a certain height is required for the addition of the front member between the speaker apparatus and a housing of an electronic device.

Aspects of the present disclosure are to address at least the above-mentioned problems and/or disadvantages and to provide at least the advantages described below. Accordingly, an aspect of the present disclosure is to provide a speaker apparatus for preventing a leakage sound using a diaphragm edge compression part without a sound leakage prevention member, and an electronic device having the same.

Another aspect of the present disclosure is to provide a speaker apparatus for guiding sound in a desired direction using a diaphragm edge compression part, and an electronic device having the same.

In accordance with an aspect of the present disclosure, a speaker apparatus is provided. The speaker apparatus includes a hollow shape frame, a magnet disposed in an internal part of the hollow shape frame, a voice coil installed in proximity to the magnet, a diaphragm including a diaphragm edge that vibrates by an electric current applied to the voice coil, and a diaphragm edge compression part extended upward along the diaphragm edge. The diaphragm edge compression part may contact an inner surface of a housing of an electronic device.

In accordance with another aspect of the present disclosure, an electronic device is provided. The electronic device includes a housing including a speaker hole, a hollow shape frame disposed in an internal part of the electronic device, and having a hollow portion formed in a position corresponding to the speaker hole, a magnet disposed in an internal part of the hollow shape frame, a voice coil installed in proximity to the magnet, a diaphragm including a diaphragm edge that vibrates by an electric current applied to the voice coil, and a diaphragm edge compression part extended upward along the diaphragm edge. The diaphragm edge compression part may contact an inner surface of the housing.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

According to various embodiments of the present disclosure, a portable terminal has been illustrated as an audio device and a speaker apparatus applied to this has been described. However, the speaker apparatus according to various embodiments of the present disclosure is applicable to various electronic sound devices that output sound.

Figure 1:
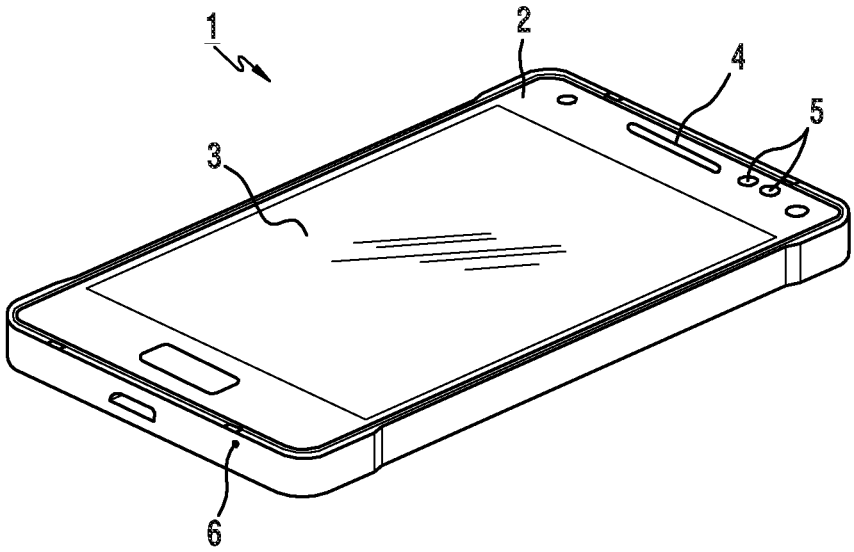
FIG. 1 is a front perspective diagram illustrating an electronic device applying a speaker apparatus according to an embodiment of the present disclosure.
Figure 2:
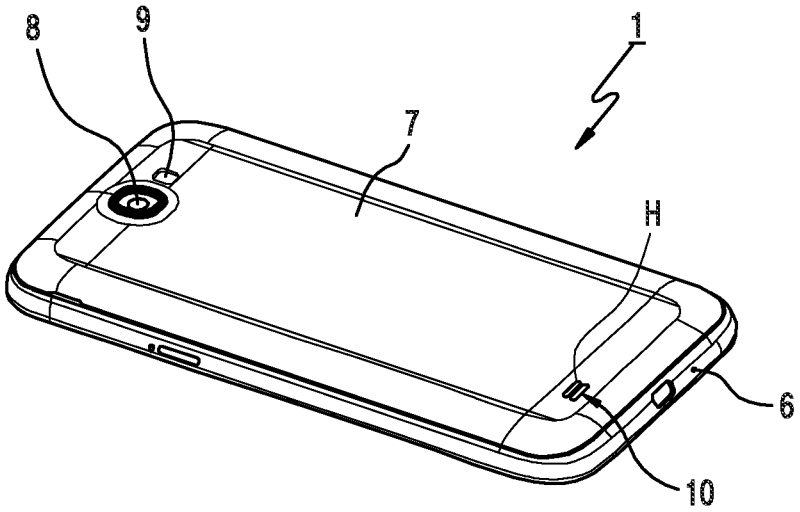
FIG. 2 is a rear perspective diagram illustrating an electronic device applying a speaker apparatus according to an embodiment of the present disclosure.

FIG. 1 is a front perspective diagram illustrating an electronic device applying a speaker apparatus according to an embodiment of the present disclosure. FIG. 2 is a rear perspective diagram illustrating the electronic device applying the speaker apparatus according to an embodiment of the present disclosure.

Referring to FIGS. 1 and 2, a display 3 may be installed in a front surface 2 of the electronic device 1. An earpiece 4 for receiving a counterpart's voice may be installed at an upper side of the display 3. A microphone device 6 for forwarding a voice to a counterpart may be installed at a lower side of the display 3.

According to an embodiment of the present disclosure, components for performing various functions of the electronic device 1 may be arranged around the earpiece 4. The components may include at least one sensor module 5. This sensor module 5 may include at least one of, for example, an illumination sensor (e.g., an optical sensor), a proximity sensor (e.g., an optical sensor), an infrared sensor, and an ultrasonic sensor. According to an embodiment of the present disclosure, the components may include a camera device, and the components may include a light emitting diode (LED) indicator for allowing a user to recognize status information of the electronic device 1.

According to an embodiment of the present disclosure, a camera device 8 and a flash device 9 for photographing a subject may be arranged in a rear surface 7 of the electronic device 1. Also, a speaker hole (H) may be provided in a housing of the rear surface 7 of the electronic device 1. A speaker apparatus 10 according to the present disclosure may be installed in an internal part of the electronic device 1 corresponding to the speaker hole (H). Accordingly, the electronic device 1 may output sound, which is generated from the speaker apparatus 10 during a multimedia function, to the external through the speaker hole (H).

Figure 3:
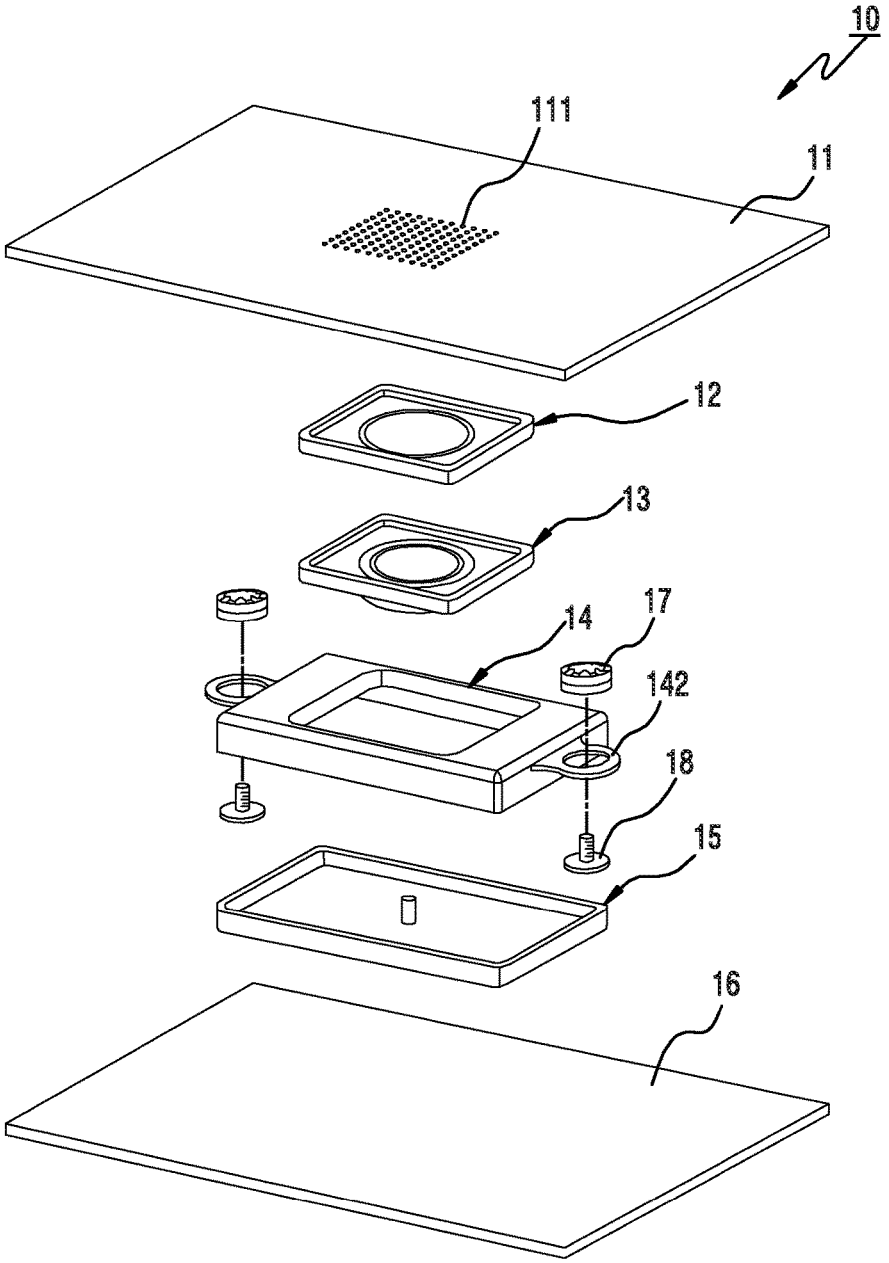
FIG. 3 is an exploded perspective diagram illustrating a speaker apparatus according to an embodiment of the present disclosure.
Figure 4:
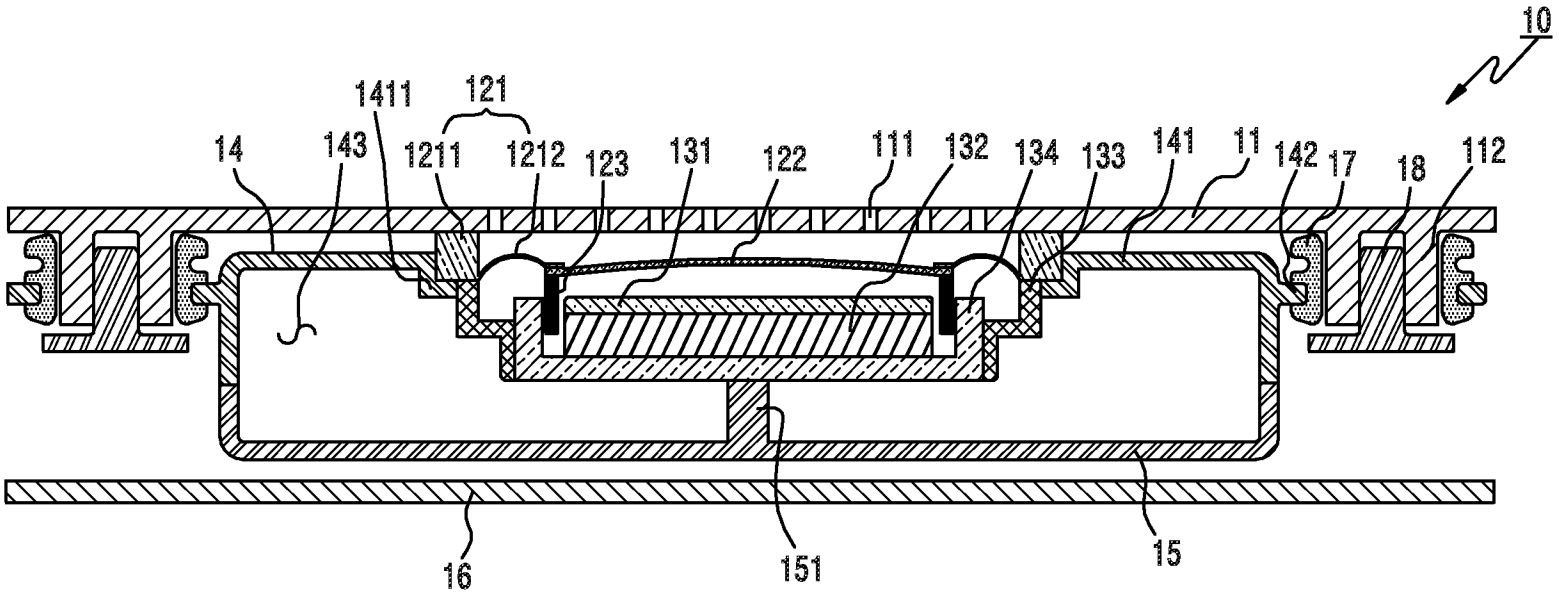
FIG. 4 is a cross section illustrating a coupled state of a speaker apparatus according to an embodiment of the present disclosure.

FIG. 3 is an exploded perspective diagram illustrating the speaker apparatus according to an embodiment of the present disclosure. FIG. 4 is a cross section illustrating a coupled state of the speaker apparatus according to an embodiment of the present disclosure.

Referring to FIGS. 3 and 4, the speaker apparatus 10, which is one assembly coupling a plurality of components, may be installed in the electronic device 1. For example, a bushing of a certain shape may be protruded from an inner surface of a housing of the electronic device 1. The aforementioned speaker apparatus 10 may be mounted or arranged on this bushing, and may be electrically connected to a mainboard of the electronic device 1.

The speaker apparatus 10 according to an embodiment of the present disclosure may include a front housing 11, a vibration part 12, a magnet part 13, an enclosure upper case 14, an enclosure lower case 15, and a rear housing 16. The front housing 11 may have a plurality of speaker sound radiation holes 111 having a certain opening area for radiating a sound from a speaker through the opening area. The vibration part 12 may be arranged on a lower part of the front housing 11 and generate sound. The magnet part 13 may support the vibration part 12 and forward an external electrical signal to the vibration part 12. The enclosure upper case 14 and the enclosure lower case 15 constructs an enclosure for accepting the magnet part 12 and forming a sound resonance space 143 therein. The rear housing 16 may be coupled with the front housing 11 to form an appearance of the electronic device 1.

According to an embodiment of the present disclosure, the vibration part 12 may be coupled with the magnet part 13 and be safely mounted within the enclosure upper case 14. The enclosure upper case 14 may be coupled with the enclosure lower case 15 in a fusion or bonding scheme, to form the sound resonance space 143 therein. According to an embodiment of the present disclosure, at least one rib 142 having a certain shape may be formed on lateral surfaces of the enclosure upper case 14. A damper 17 of a rubber material may be fitted into the rib 142. The rib 142 may have a clamping part for clamping the front housing 11 and the enclosure upper case 14 by a screw 18.

According to an embodiment of the present disclosure, the vibration part 12 may include a diaphragm edge 121, a diaphragm 122, and a voice coil 123. The diaphragm 122 may generate a speaker sound. The voice coil 123 may be laminated on a lower part of the diaphragm 122. The voice coil 123 may be arranged such that the up/down flowage of the voice coil 123 is possible by a non-alternating (direct current) magnetic flux generated in a magnetic circuit of a magnet 132, the diaphragm 122, and the damper 17. The diaphragm edge 121 may be laminated on an upper part of the diaphragm 122. The diaphragm 122 may have a dome shape, and may be intervened between the diaphragm edge 121 and the voice coil 123. However, the vibration part 12 is not limited to this, and the diaphragm 122 may be arranged on an upper part of the diaphragm edge 121. The diaphragm 122 and the diaphragm edge 121 may be integrated and constructed as one single component. After the diaphragm 122 may be first fixed with the diaphragm edge 121, the voice coil 123 may be laminated on a lower part of the diaphragm 122. The vibration part 12 may generate a sound corresponding to a driving signal by vibrating up/down the aforementioned diaphragm 122 and voice coil 123 by means of attractive and repulsive forces, which are generated by the interaction of an alternating (alternating current) rotation magnetic flux generated in the voice coil 123 in compliance with Fleming's left hand rule. The diaphragm edge 121 may include a diaphragm edge compression part 1211 and a diaphragm edge vibration part 1212. The diaphragm edge compression part 1211 is extended upward at a certain height along a corner of the diaphragm edge vibration part 1212. The diaphragm edge vibration part 1212 may have an opening of a certain size. The diaphragm edge 121 may be formed integrally with the diaphragm edge compression part 1211. For example, the diaphragm edge 121 may be formed of flexible materials of rubber that are compressible at a certain rate (e.g., 10% or more) and having a certain tension. The diaphragm edge compression part 1211 may have a certain height to adhere the vibration part 12 close to the front housing 11 of the electronic device 1.

The magnet part 13 may include a plate 131, the magnet 132, a hollow shape frame 133, and a yoke 134. The hollow shape frame 133 may have a certain shape. The yoke 134 may be accepted in an internal space of the hollow shape frame 133. The magnet 132 and the plate 131 may be sequentially laminated on an upper part of the yoke 134. The yoke 134 may be mounted on a step part protruded from a hollow-shape inner side of the hollow shape frame 133. The magnet 132 may be installed along a circumference part of the plate 131 and the plate type yoke 134 may be laminated at a lower side of the magnet 132, whereby the magnet part 13 is assembled. According to an embodiment of the present disclosure, the plate 131, the magnet 132, and the yoke 134 may guide to form a magnetic field suitable to the voice coil 123, and may be supported and fixed by the hollow shape frame 133. At least one printed circuit board (PCB) 135 for forwarding an external signal to the voice coil 123 may be installed within the hollow shape frame 133. This PCB 135 may be installed on an inner surface or outer surface of the hollow shape frame 133, and may be fixed to the hollow shape frame 133 of synthetic resin materials in an insert molding scheme. For example, the hollow shape frame 133 may be injected integrally with the PCB 135. The PCB 135 may be implemented as a flexible PCB (FPCB), and may be connected to the main board of the electronic device 1 through a cable or flexible printed circuit (FPC). The magnet 132 and the yoke 134 may be fixed to the hollow shape frame 133 in an insert molding scheme. However, the fixing is not limited to this, and a known clamping scheme such as a screw, bonding, etc. may instead be employed.

According to an embodiment of the present disclosure, the enclosure upper case 14 may include a hollow shape body part 141 whose bottom surface is opened, and a rib 142 including a clamping part extended at a certain length from a lateral surface of the body part 141. According to an embodiment of the present disclosure, the enclosure lower case 15 may be formed to have an opened top surface and have a size corresponding to the enclosure upper case 14. The enclosure lower case 15 may be coupled with the opened bottom surface of the enclosure upper case 14 to form the sound resonance space 143. The enclosure upper case 14 may be adhered and fixed with the enclosure lower case 15 in a fusion or bonding scheme. According to an embodiment of the present disclosure, the damper 17 of a rubber material may be fitted into the clamping part of the rib 142 of the enclosure upper case 14. Thereafter, the damper 17 may be fitted to a screw clamping part 112 protruded from a lower side of the front housing 11, and the screw 18 may be clamped to a clamping recess of the screw clamping part 112, whereby the enclosure upper case 14 and the front housing 11 may be firmly fixed to each other. However, a method of clamping the speaker apparatus 10 to the front housing 11 is not limited to this. For example, the speaker apparatus 10 may be fixed to the front housing 11 in various clamping schemes such as a fixing double-sided tape, a hook clamping structure, etc.

According to an embodiment of the present disclosure, the speaker apparatus 10 may be assembled with the enclosure upper case 14 and enclosure lower case 15 for forming the sound resonance space 143 therein. The enclosure lower case 15 may have a support boss 151 for supporting in a height direction the vibration part 12 and the magnet part 13 safely mounted within the enclosure upper case 14. The enclosure upper case 14 may have a safe mounting part 1411 for safely mounting the aforementioned vibration part 12 and magnet part 13 in its internal space. The safe mounting part 1411 may be protruded from an inner surface of the enclosure upper case 14. The vibration part 12 and the magnet part 13 may be safely mounted in a fixed state on the safe mounting part 1411.

According to an embodiment of the present disclosure, the hollow shape frame 133 having a certain shape may be arranged in an internal part of the enclosure upper case 14. The plate type yoke 134 may be installed in an internal space of the hollow shape frame 133, and the magnet 132 and the plate 131 may be sequentially laminated on an upper part of the yoke 134. The diaphragm 122 may be arranged on an upper part of the hollow shape frame 133. The voice coil 123 may be arranged on a lower part of the diaphragm 122 such that the up/down flowage of the voice coil 123 is possible by a non-alternating (direct current) magnetic flux generated in a magnetic circuit of the magnet 132, the diaphragm 122, and the damper 17. The diaphragm edge 121 may be laminated on an upper part of the diaphragm 122. The diaphragm edge 121 may have the diaphragm edge vibration part 1212, and the diaphragm edge compression part 1211 extending upward along the corner of the diaphragm edge vibration part 1212. The diaphragm edge compression part 1211 may be fixed with at least a portion of the hollow shape frame 133, and may be adhered and fixed to at least a portion of the front housing 11. A fixing method may use a bond or double-sided tape, but the fixing method is not limited to this.

Figure 5:
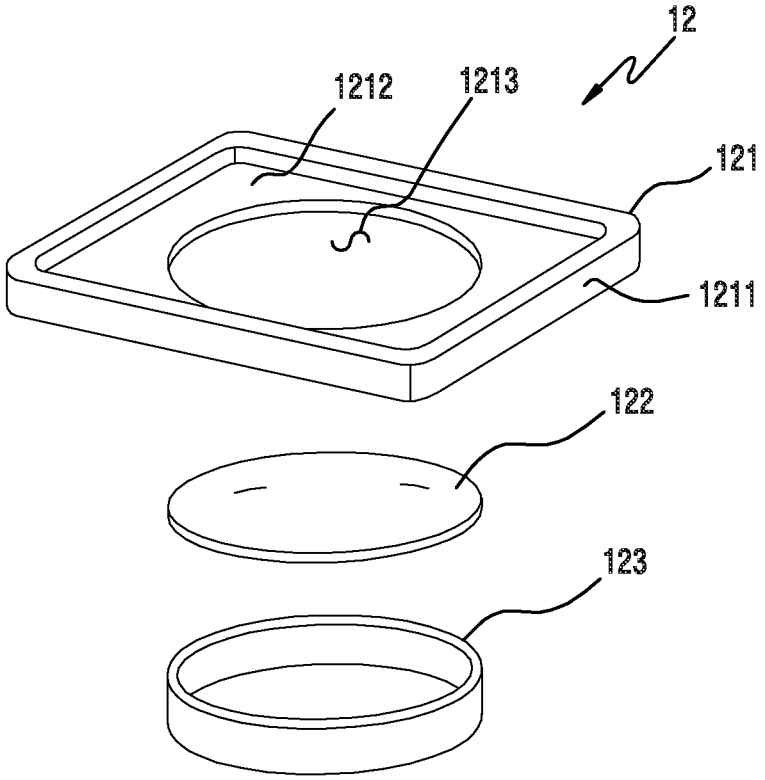
FIG. 5 is an exploded perspective diagram illustrating a vibration part according to an embodiment of the present disclosure.
Figure 6:
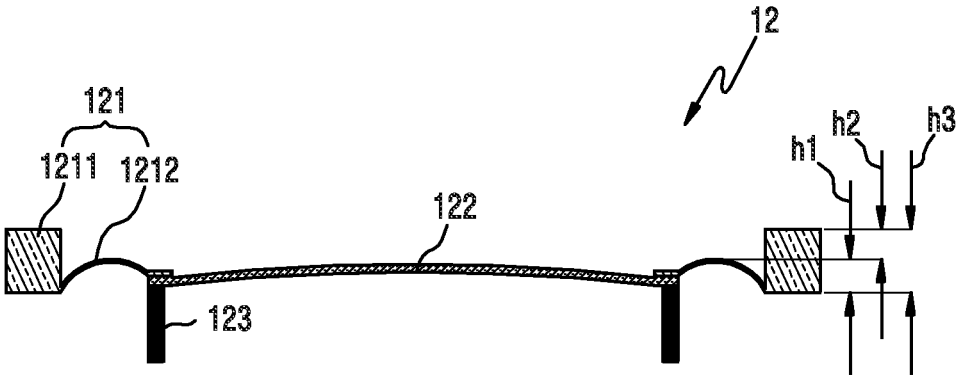
FIG. 6 is a cross section illustrating a coupled state of a vibration part according to an embodiment of the present disclosure.

FIG. 5 is an exploded perspective diagram illustrating the vibration part according to an embodiment of the present disclosure. FIG. 6 is a cross section illustrating a coupled state of the vibration part according to an embodiment of the present disclosure.

Referring to FIGS. 5 and 6, the vibration part 12 may include the diaphragm edge 121, the diaphragm 122, and the voice coil 123. The diaphragm 122 may generate a speaker sound. The voice coil 123 may be laminated on a lower part of the diaphragm 122. The voice coil 123 may be arranged such that the up/down flowage of the voice coil 123 is possible by a non-alternating (direct current) magnetic flux generated in the magnetic circuit of the magnet 132, the diaphragm 122, and the damper 17. The diaphragm edge 121 may be laminated on an upper part of the diaphragm 122. According to an embodiment of the present disclosure, the diaphragm 122 may have a dome shape, and may be intervened between the diaphragm edge 121 and the voice coil 123. However, the vibration part 12 is not limited to this, and the diaphragm 122 may be arranged on an upper part of the diaphragm edge 121. The diaphragm 122 and the diaphragm edge 121 may be integrated and constructed as one single component. After the diaphragm 122 may be first fixed with the diaphragm edge 121, the voice coil 123 may be laminated on a lower part of the diaphragm 122. According to an embodiment of the present disclosure, the vibration part 12 may generate a sound corresponding to a driving signal by vibrating up/down the aforementioned diaphragm 122 and voice coil 123 by means of attractive and repulsive forces, which are generated by the interaction of an alternating (alternating current) rotation magnetic flux generated in the voice coil 123 in compliance with Fleming's left hand rule.

According to an embodiment of the present disclosure, the diaphragm edge 121 may include the diaphragm edge compression part 1211 and the diaphragm edge vibration part 1212. The diaphragm edge compression part 1211 is extended upward at a certain height along the corner of the diaphragm edge vibration part 1212. The diaphragm edge vibration part 1212 may have the opening 1213 of the certain size. The diaphragm edge 121 may be formed integrally with the diaphragm edge compression part 1211. For example, the diaphragm edge 121 may be formed of flexible materials of rubber that are compressible at a certain rate (e.g., 10% or more) and having a certain tension. The diaphragm edge compression part 1211 may have a certain height to adhere the vibration part 12 close to the front housing 11 of the electronic device 1. According to an embodiment of the present disclosure, a height (h3) of the diaphragm edge compression part 1211 may be set in consideration of a height (h1) of the diaphragm edge vibration part 1212 of the diaphragm edge 121, the amplitude (h2) of the diaphragm 122 and the diaphragm edge 121, and a compression rate of the diaphragm edge compression part 1211. For example, the amplitude (h2) of the diaphragm 122 may apply a numerical value representing the greatest variation among variations of the diaphragm 122 measured in a rated output condition. Additionally, the diaphragm edge compression part 1211 may reflect a numerical value of a certain height according to an assembly tolerance of the speaker apparatus 10, and may be designed in consideration of a decrease of a vibration height of the diaphragm 122 caused by internal air damping dependent on an air capacity of the internal sound resonance space 143.

Figure 7:
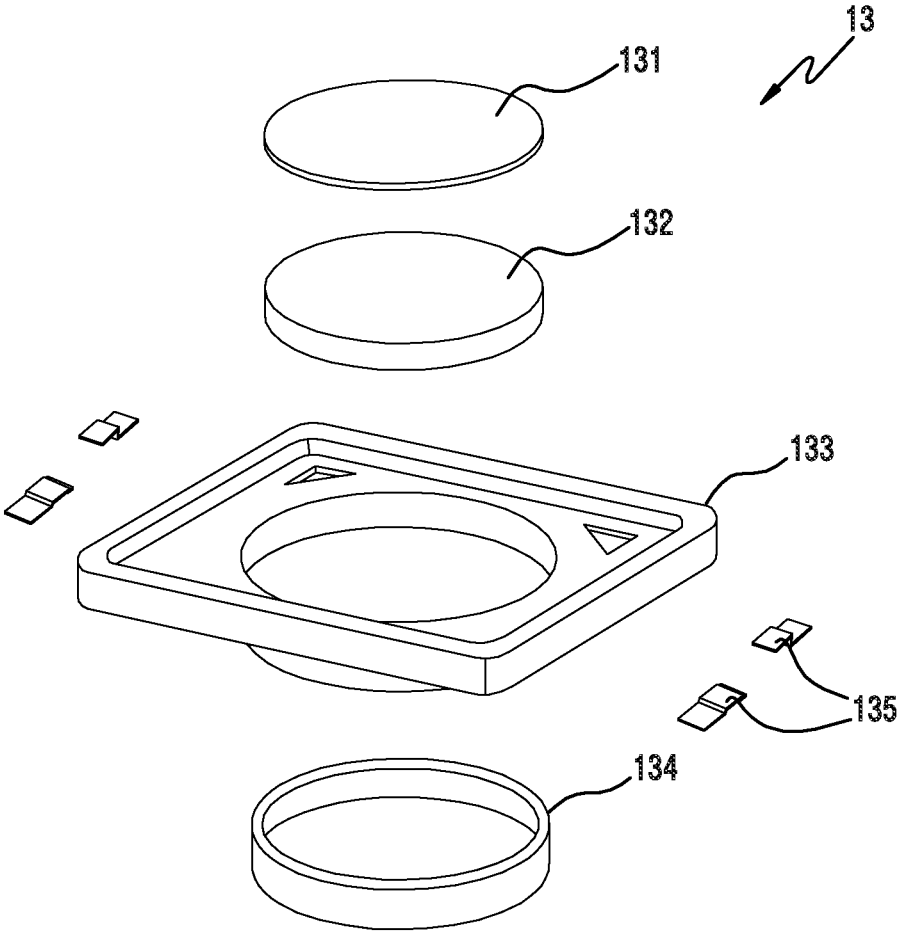
FIG. 7 is an exploded perspective diagram illustrating a magnet part according to an embodiment of the present disclosure.
Figure 8:
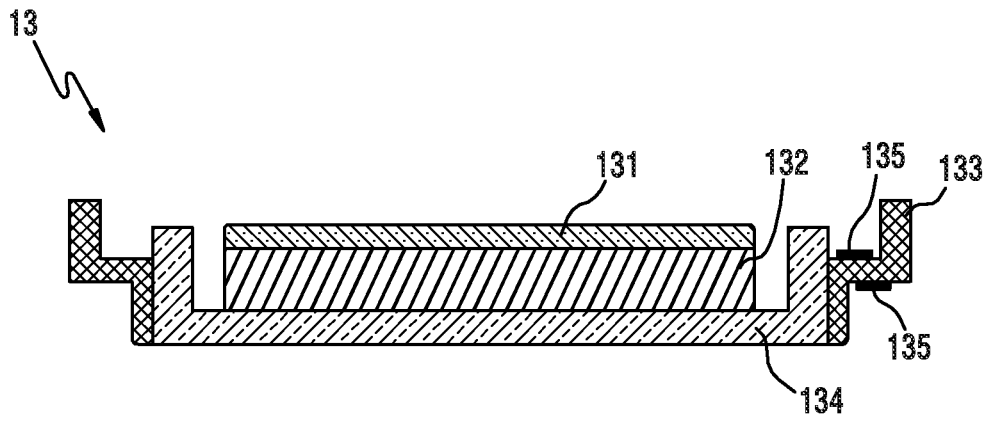
FIG. 8 is a cross section illustrating a coupled state of a magnet part according to an embodiment of the present disclosure.

FIG. 7 is an exploded perspective diagram illustrating the magnet part according to an embodiment of the present disclosure. FIG. 8 is a cross section illustrating a coupled state of the magnet part according to an embodiment of the present disclosure.

Referring to FIGS. 7 and 8, the magnet part 13 may include the plate 131, the magnet 132, the hollow shape frame 133, and the yoke 134. The hollow shape frame 133 may have a certain shape. The yoke 134 may be accepted in the internal space of the hollow shape frame 133. The magnet 132 and the plate 131 may be sequentially laminated on the upper part of the yoke 134. According to an embodiment of the present disclosure, the yoke 134 may be mounted on a step part protruded from a hollow-shape inner side of the hollow shape frame 133. The magnet 132 may be installed along a circumference part of the plate 131 and the plate type yoke 134 may be laminated at a lower side of the magnet 132, whereby the magnet part 13 is assembled. According to an embodiment of the present disclosure, the plate 131, the magnet 132, and the yoke 134 may guide to form a magnetic field suitable to the voice coil 123, and may be supported and fixed by the hollow shape frame 133.

At least one PCB 135 for forwarding an external signal to the voice coil 123 may be installed within the hollow shape frame 133. This PCB 135 may be installed on an inner surface or outer surface of the hollow shape frame 133, and may be fixed to the hollow shape frame 133 of synthetic resin materials in an insert molding scheme. For example, the hollow shape frame 133 may be injected integrally with the PCB 135. According to an embodiment of the present disclosure, the PCB 135 may be implemented as an FPCB, and may be connected to the main board of the electronic device 1 through a cable or FPC. According to an embodiment of the present disclosure, the magnet 132 and the yoke 134 may be fixed to the hollow shape frame 133 in an insert molding scheme. However, the fixing is not limited to this, and a known clamping scheme such as a screw, bonding, etc. may instead be employed.

Figure 9:
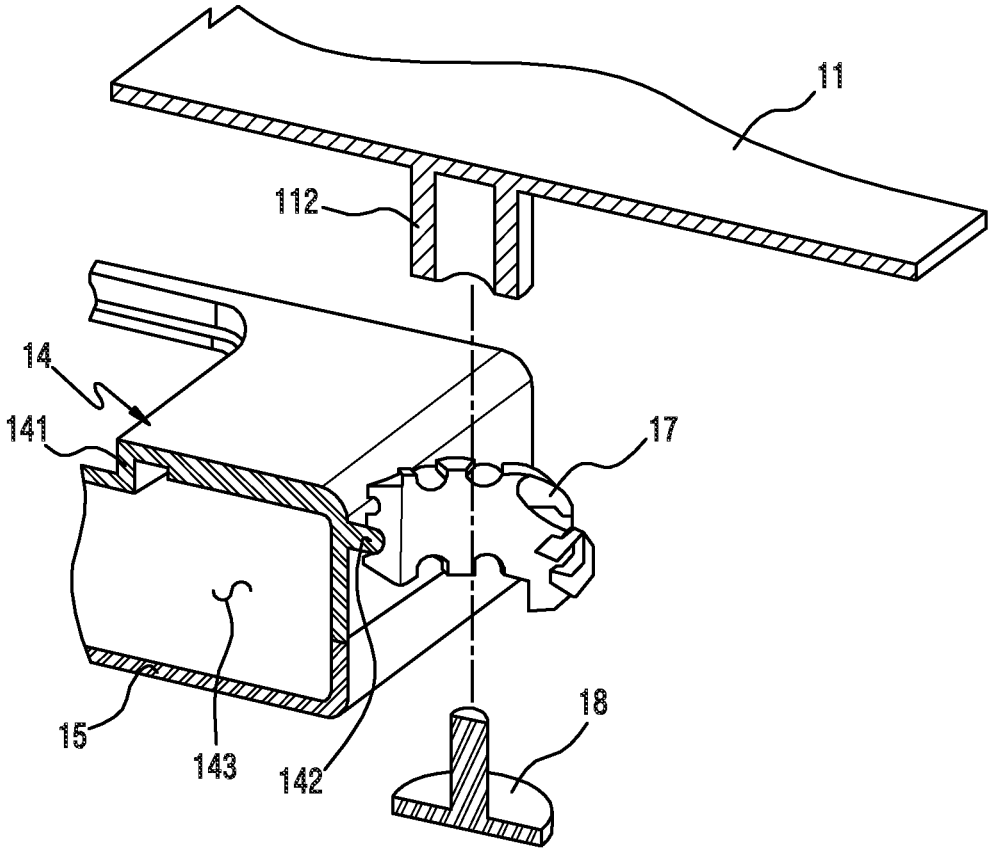
FIG. 9 illustrates a method for clamping a speaker apparatus to a front housing according to an embodiment of the present disclosure.
Figure 10:
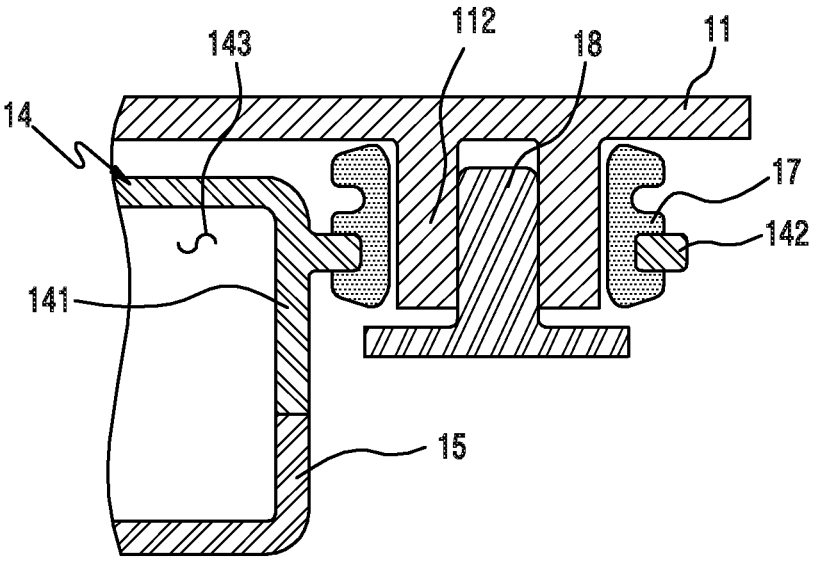
FIG. 10 is a cutaway diagram illustrating a state of clamping a speaker apparatus to a front housing according to an embodiment of the present disclosure.

FIG. 9 illustrates a method for clamping the speaker apparatus to the front housing according to an embodiment of the present disclosure. FIG. 10 is a cutaway diagram illustrating a state of clamping the speaker apparatus to the front housing according to an embodiment of the present disclosure.

Referring to FIGS. 9 and 10, the enclosure upper case 14 may include the hollow shape body part 141 whose bottom surface is opened, and the rib 142 including the clamping part extended at a certain length from the lateral surface of the body part 141. According to an embodiment of the present disclosure, the enclosure lower case 15 may be formed to have the opened top surface and have the size corresponding to the enclosure upper case 14. The enclosure lower case 15 may be coupled with the opened bottom surface of the enclosure upper case 14 to form the sound resonance space 143. The enclosure upper case 14 may be adhered and fixed with the enclosure lower case 15 in a fusion or bonding scheme.

According to an embodiment of the present disclosure, the damper 17 of a rubber material may be fitted into the clamping part of the rib 142 of the enclosure upper case 14. Thereafter, the damper 17 may be fitted to a screw clamping part 112 protruded from a lower side of the front housing 11, and the screw 18 may be clamped to a clamping recess of the screw clamping part 112, whereby the enclosure upper case 14 and the front housing 11 may be firmly fixed to each other. However, a method of clamping the speaker apparatus 10 to the front housing 11 is not limited to this. For example, the speaker apparatus 10 may be fixed to the front housing 11 in various clamping schemes such as a fixing double-sided tape, a hook clamping structure, etc.

Figure 11:
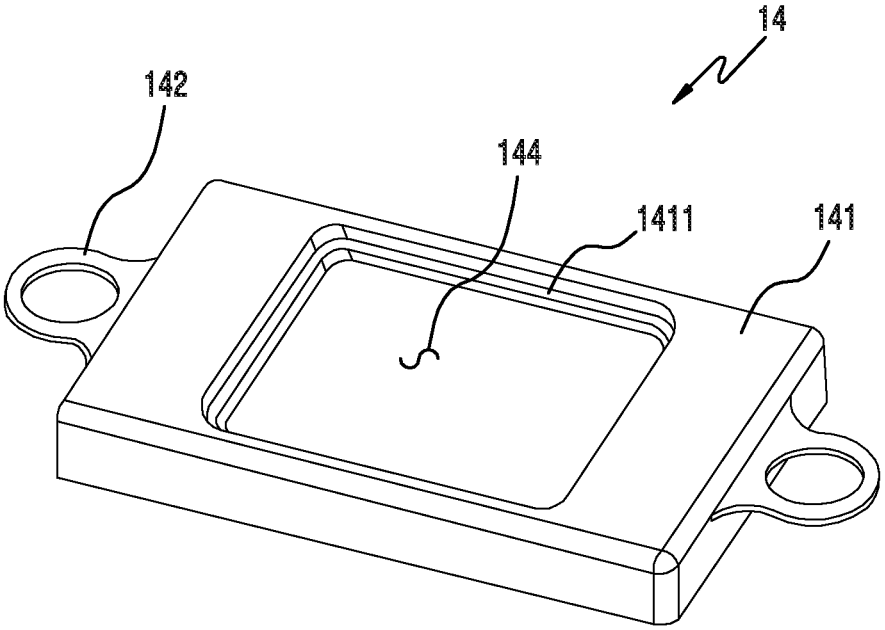
FIG. 11 is a perspective diagram illustrating an enclosure upper case according to an embodiment of the present disclosure.
Figure 12:
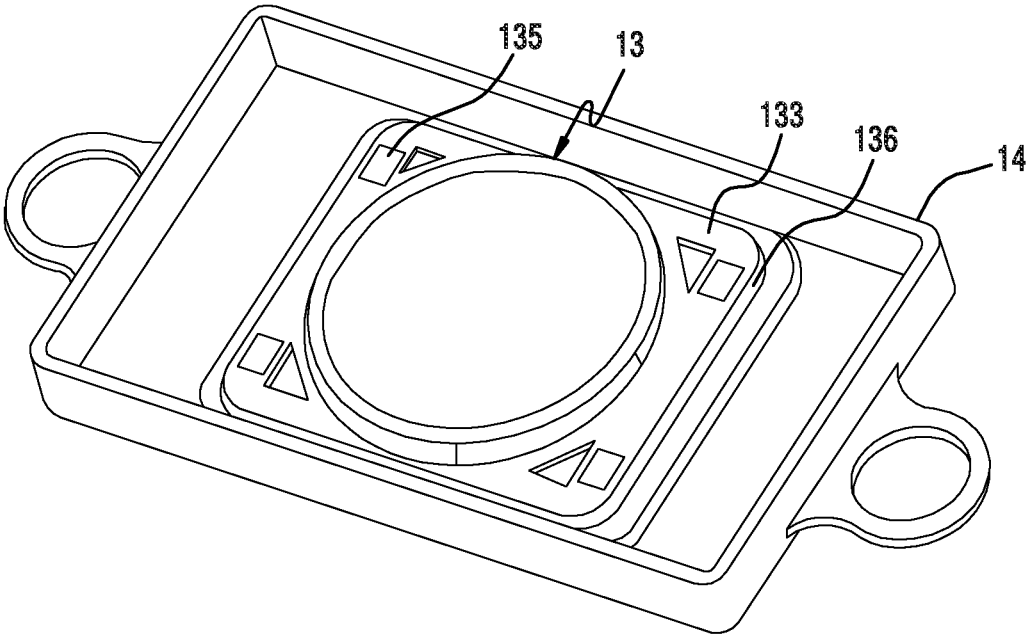
FIG. 12 is a rear perspective diagram illustrating a state of coupling an enclosure upper case and a speaker apparatus according to an embodiment of the present disclosure.
Figure 13:
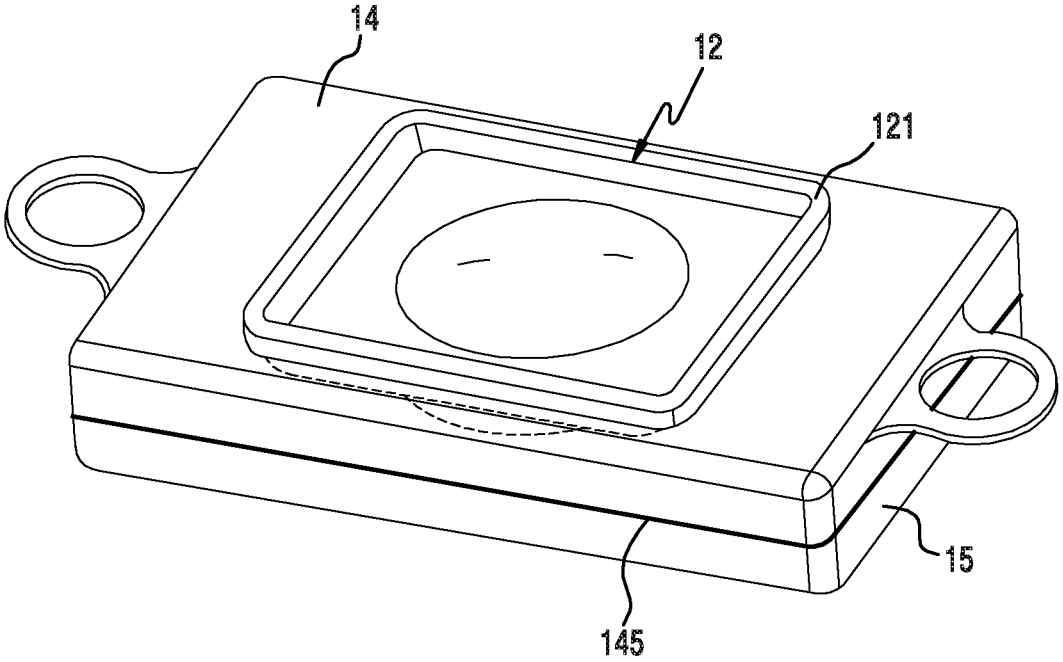
FIG. 13 is a perspective diagram illustrating a state of assembling an enclosure lower case in a state of coupling an enclosure upper case and a speaker apparatus according to an embodiment of the present disclosure.

FIG. 11 is a perspective diagram illustrating the enclosure upper case according to an embodiment of the present disclosure. FIG. 12 is a rear perspective diagram illustrating a state of coupling the enclosure upper case and the speaker apparatus according to an embodiment of the present disclosure. FIG. 13 is a perspective diagram illustrating a state of assembling the enclosure lower case in a state of coupling the enclosure upper case and the speaker apparatus according to an embodiment of the present disclosure.

FIGS. 11 to 13 illustrate a method of assembling the enclosure upper case 14, the speaker apparatus, and the enclosure lower case 15 according to an embodiment of the present disclosure. Here, the speaker apparatus may be in a state in which the aforementioned vibration part 12 and magnet part 13 are assembled with each other.

Referring to FIGS. 11 to 13, the enclosure upper case 14 may include the hollow shape body part 141 whose bottom surface is opened, and the rib 142 including the clamping part extended at a certain length from the lateral surface of the body part 141. The enclosure upper case 14 may include the safe mounting part 1411 for safely mounting the speaker apparatus in which the aforementioned vibration part 12 and magnet part 13 are assembled, in an internal space 144 of the enclosure upper case 14. The safe mounting part 1411 may be protruded from an inner surface of the enclosure upper case 14. The safe mounting part 1411 may play a role of adhering and fixing the diaphragm edge compression part 1211 of the aforementioned diaphragm edge 121 to the front housing 11 of the electronic device 1. Also, if the speaker apparatus is safely mounted on the safe mounting part 1411 of the enclosure upper case 14, an adhesive such as a bond, etc. for secondary fixing may be coated on a contact surface 136 between the hollow shape frame 133 and the enclosure upper case 14. If the speaker apparatus is safely mounted on the safe mounting part 1411 of the enclosure upper case 14, at least one PCB 135 installed in a specific area of the hollow shape frame 133 may be connected with the mainboard of the electronic device 1.

Thereafter, the enclosure lower case 15 having a shape corresponding to the enclosure upper case 14 may be connected to a lower part of the enclosure upper case 14. Accordingly, in case that the enclosure upper case 14 and the enclosure lower case 15 are assembled to each other, it may form the sound resonance space 143. According to an embodiment of the present disclosure, the enclosure upper case 14 and the enclosure lower case 15 may be adhered and fixed through a clamping part of the rib 142. A clamping method may use an ultrasonic fusion or bonding scheme.

According to an embodiment of the present disclosure, the support boss (151 of FIG. 14) may be formed on one surface of the enclosure lower case 15, and may support the aforementioned speaker apparatus in a height direction and constantly compress the diaphragm edge 12 in a height direction. However, besides the support boss 151, a separate member may be applied. In this case, for example, a height and material of the separate member should be defined such that the separate member may compress and fix the diaphragm edge compression part 1211 of the diaphragm edge 121 at a certain rate.

Figure 14:
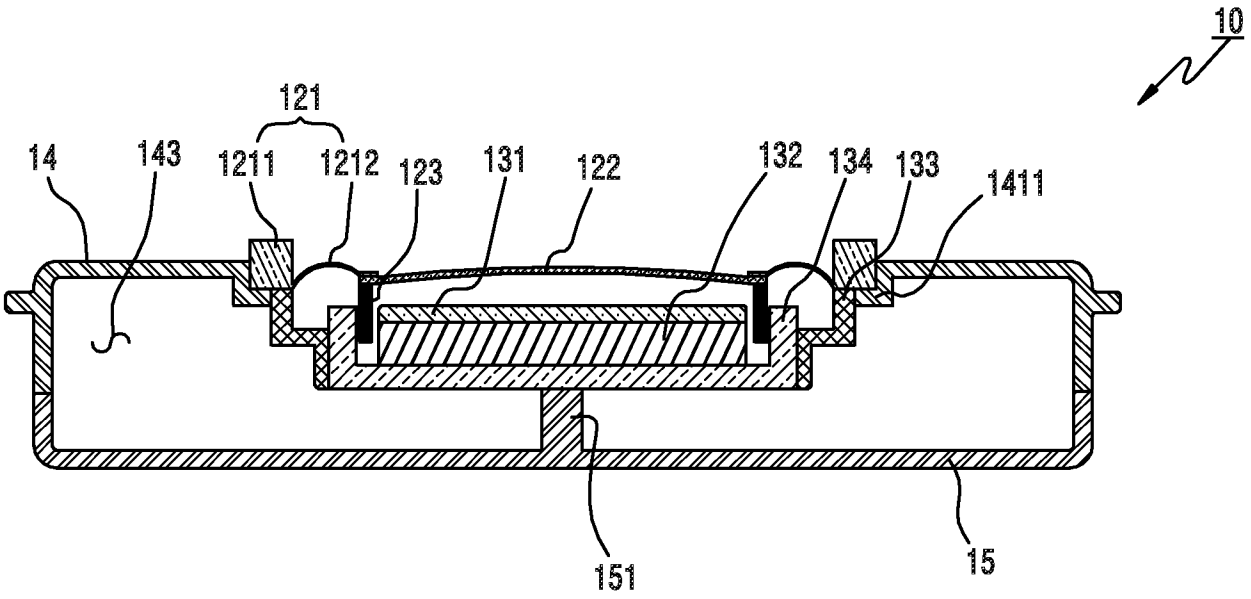
FIG. 14 is a cross section illustrating a coupled state of a speaker apparatus according to an embodiment of the present disclosure.

FIG. 14 is a cross section illustrating a coupled state of the speaker apparatus according to an embodiment of the present disclosure.

Referring to FIG. 14, the speaker apparatus 10 may be assembled with the enclosure upper case 14 and enclosure lower case 15 for forming the sound resonance space 143 therein. The enclosure lower case 15 may have a support boss 151 for supporting in a height direction the vibration part 12 and the magnet part 13 safely mounted within the enclosure upper case 14. The enclosure upper case 14 may have the safe mounting part 1411 for safely mounting the aforementioned vibration part 12 and magnet part 13 in its internal space. The safe mounting part 1411 may be protruded from an inner surface of the enclosure upper case 14. The vibration part 12 and the magnet part 13 may be safely mounted in a fixed state on the safe mounting part 1411.

The hollow shape frame 133 having a certain shape may be arranged in an internal part of the enclosure upper case 14. The plate type yoke 134 may be installed in an internal space of the hollow shape frame 133, and the magnet 132 and the plate 131 may be sequentially laminated on an upper part of the yoke 134. The diaphragm 122 may be arranged on an upper part of the hollow shape frame 133. The voice coil 123 may be arranged on a lower part of the diaphragm 122 such that the up/down flowage of the voice coil 123 is possible by a non-alternating (direct current) magnetic flux generated in a magnetic circuit of the magnet 132, the diaphragm 122, and the damper 17. The diaphragm edge 121 may be laminated on an upper part of the diaphragm 122. The diaphragm edge 121 may have the diaphragm edge vibration part 1212, and the diaphragm edge compression part 1211 extending upward along the corner of the diaphragm edge vibration part 1212. The diaphragm edge compression part 1211 may be fixed with at least a portion of the hollow shape frame 133, and may be adhered and fixed to at least a portion of the front housing 11. A fixing method may use a bond or double-sided tape, but it is not limited to this.

Figure 15:
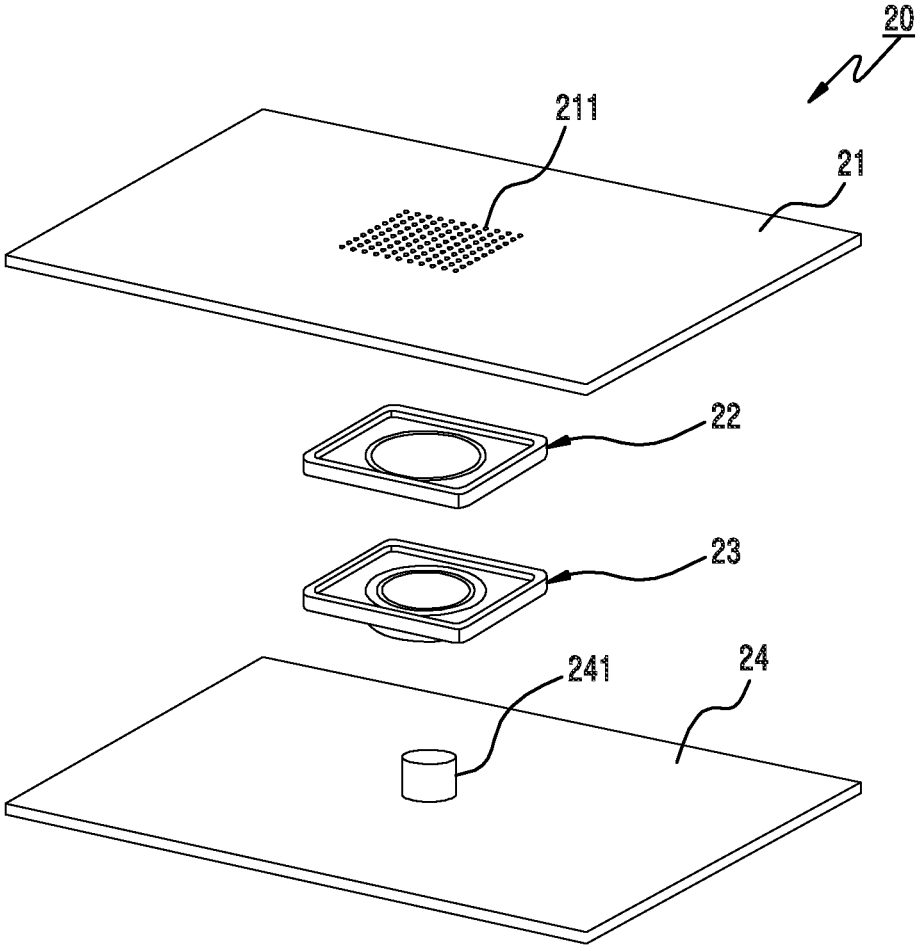
FIG. 15 is an exploded perspective diagram illustrating a speaker apparatus according to an embodiment of the present disclosure.
Figure 16:
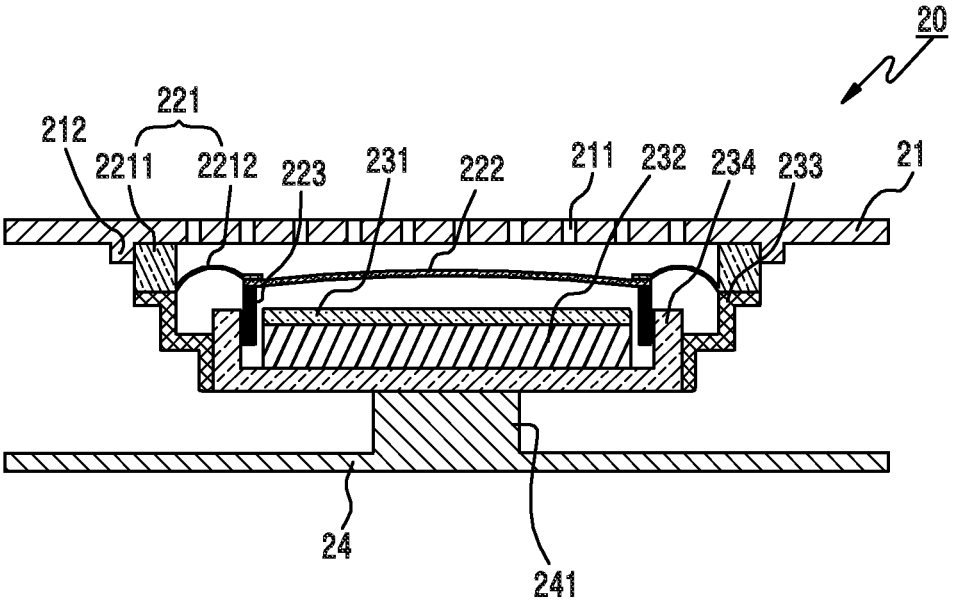
FIG. 16 is a cross section illustrating a coupled state of a speaker apparatus according to an embodiment of the present disclosure.

FIG. 15 is an exploded perspective diagram illustrating a speaker apparatus according to an embodiment of the present disclosure. FIG. 16 is a cross section illustrating a coupled state of the speaker apparatus according to an embodiment of the present disclosure.

Referring to FIGS. 15 and 16, the speaker apparatus 20, which is one assembly coupling a plurality of components, may be installed in the electronic device 1. For example, a bushing of a certain shape may be protruded from an inner surface of a housing of the electronic device 1. The aforementioned speaker apparatus 20 may be mounted or arranged on this bushing, and may be electrically connected to a mainboard of the electronic device 1.

The speaker apparatus 20 according to an embodiment of the present disclosure may be a speaker structure not applying an enclosure forming a resonance space. The speaker apparatus 20 may include a front housing 21, a vibration part 22, a magnet part 23, and a rear housing 24. The front housing 21 may have a plurality of speaker sound radiation holes 211 having a certain opening area and for radiating a speaker sound through the opening area. The vibration part 22 may be arranged on a lower part of the front housing 21 and generate sound. The magnet part 23 may support the vibration part 22 and forward an external electrical signal to the vibration part 22. The rear housing 24 may be coupled with the front housing 21 to form an appearance of the electronic device 1.

The vibration part 22 may include a diaphragm edge 221, a diaphragm 222, and a voice coil 223. The diaphragm 222 may generate a speaker sound. The voice coil 223 may be laminated on a lower part of the diaphragm 222. The voice coil 223 may be arranged such that the up/down flowage of the voice coil 223 is possible by a non-alternating (direct current) magnetic flux generated in a magnetic circuit of a magnet 232, the diaphragm 222, and a damper. The diaphragm edge 221 may be laminated on an upper part of the diaphragm 222. The diaphragm 222 may have a dome shape, and may be intervened between the diaphragm edge 221 and the voice coil 223. However, vibration part 22 is not limited to this, and the diaphragm 222 may be arranged on an upper part of the diaphragm edge 221. After the diaphragm 222 may be first fixed with the diaphragm edge 221, the voice coil 223 may be laminated on a lower part of the diaphragm 222. The vibration part 22 may generate a sound corresponding to a driving signal by vibrating up/down the aforementioned diaphragm 222 and voice coil 223 by means of attractive and repulsive forces, which are generated by the interaction of an alternating (alternating current) rotation magnetic flux generated in the voice coil 223 in compliance with Fleming's left hand rule. The diaphragm edge 221 may include a diaphragm edge compression part 2211 and a diaphragm edge vibration part 2212. The diaphragm edge compression part 2211 is extended upward at a certain height along the corner of the diaphragm edge vibration part 2212. For example, the diaphragm edge 221 may be formed of flexible materials of rubber that are compressible at a certain rate (e.g., 10% or more) and having a certain tension. The diaphragm edge compression part 2211 may have a certain height to adhere the vibration part 22 close to the front housing 21 of the electronic device 1.

The magnet part 23 may include a plate 231, the magnet 232, a hollow shape frame 233, and a yoke 234. The hollow shape frame 233 may have a certain shape. The yoke 234 may be accepted in an internal space of the hollow shape frame 233. The magnet 232 and the plate 231 may be sequentially laminated on an upper part of the yoke 234. The yoke 234 may be mounted on a step part protruded from a hollow-shape inner side of the hollow shape frame 233. The magnet 232 may be installed along a circumference part of the plate 231 and the plate type yoke 234 may be laminated at a lower side of the magnet 232, whereby the magnet part 23 is assembled. According to an embodiment of the present disclosure, the plate 231, the magnet 232, and the yoke 234 may guide to form a magnetic field suitable to the voice coil 223, and may be supported and fixed by the hollow shape frame 233. At least one PCB for forwarding an external signal to the voice coil 223 may be installed within the hollow shape frame 233. This PCB may be installed on an inner surface or outer surface of the hollow shape frame 233, and may be fixed to the hollow shape frame 233 of synthetic resin materials in an insert molding scheme. For example, the hollow shape frame 233 may be injected integrally with the PCB. The PCB may be implemented as an FPCB, and may be connected to the main board of the electronic device 1 through a cable or FPC. The magnet 232 and the yoke 234 may be fixed to the hollow shape frame 233 in an insert molding scheme. However, the fixing is not limited to this, and a known clamping scheme such as a screw, bonding, etc. may instead be employed.

The front housing 21 may have the plurality of speaker sound radiation holes 211 having the certain opening area and for radiating a speaker sound through the certain opening area. The speaker sound radiation hole 211 may be applied in various forms such as a dome, a bar, etc. in addition to a circular shape. The front housing 21 may have a support rib 212 of a certain shape extended downward. At speaker apparatus 20 assembling, the support rib 212 may play a role of an assembly guide. After speaker apparatus 20 assembling, the support rib 212 may prevent the left/right flowage of the speaker apparatus 20 dependent on vibration. The rear housing 24 may have a support boss 241 for supporting the aforementioned vibration part 22 and magnet part 23 in a height direction.

The hollow shape frame 233 having a certain shape may be arranged at an upper side of the support boss 241. The plate type yoke 234 may be installed in an internal space of the hollow shape frame 233, and the magnet 232 and the plate 231 may be sequentially laminated on an upper part of the yoke 234. The diaphragm 222 may be arranged on an upper part of the hollow shape frame 233. The voice coil 223 may be arranged on a lower part of the diaphragm 222 such that the up/down flowage of the voice coil 223 is possible by a non-alternating (direct current) magnetic flux generated in a magnetic circuit of the magnet 232, the diaphragm 222, and the damper. The diaphragm edge 221 may be laminated on an upper part of the diaphragm 222. The diaphragm edge 221 may have a diaphragm edge vibration part 1212, and a diaphragm edge compression part 2211 extending upward along the corner of the diaphragm edge vibration part 1212. The front housing 21 may be arranged on an upper part of the diaphragm edge compression part 2211, and the diaphragm edge compression part 2211 may come in contact with the support rib 212 formed on a lower surface of the front housing 21. At least a portion of the diaphragm edge compression part 2211 may be fixed with at least a portion of the support rib 212 coming in contact with the front housing 21. A fixing method may use a bond or double-sided tape, but it is not limited to this.

Figure 17:
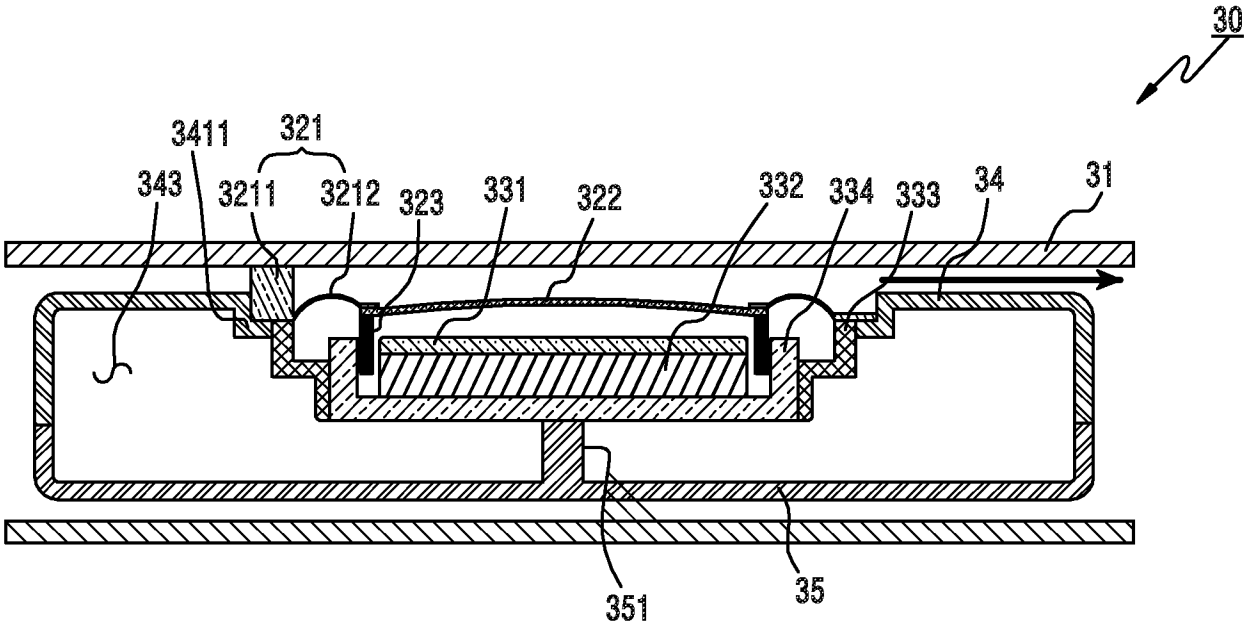
FIG. 17 is a cross section illustrating a coupled state of a speaker apparatus according to an embodiment of the present disclosure.

FIG. 17 is a cross section illustrating a coupled state of a speaker apparatus according to an embodiment of the present disclosure.

Referring to FIG. 17, the speaker apparatus 30, which is one assembly coupling a plurality of components, may be installed in the electronic device 1. For example, a bushing of a certain shape may be protruded from an inner surface of a housing of the electronic device 1. The aforementioned speaker apparatus 30 may be mounted or arranged on this bushing, and may be electrically connected to a mainboard of the electronic device 1.

The speaker apparatus 30 according to an embodiment of the present disclosure may be assembled with an enclosure upper case 34 and enclosure lower case 35 for forming a sound resonance space 343 therein. The enclosure lower case 35 may have a support boss 351 for supporting in a height direction a vibration part and a magnet part safely mounted within the enclosure upper case 34. The enclosure upper case 34 may have a safe mounting part 3411 for safely mounting the aforementioned vibration part and magnet part in its internal space. The safe mounting part 3411 may be protruded from an inner surface of the enclosure upper case 34. The vibration part and the magnet part may be safely mounted in a fixed state on the safe mounting part 3411.

A hollow shape frame 333 having a certain shape may be arranged in an internal part of the enclosure upper case 34. A plate type yoke 334 may be installed in an internal space of the hollow shape frame 333, and a magnet 332 and a plate 331 may be sequentially laminated on an upper part of the yoke 334. The diaphragm 322 may be arranged on an upper part of the hollow shape frame 333. A voice coil 323 may be arranged on a lower part of the diaphragm 322 such that the up/down flowage of the voice coil 323 is possible by a non-alternating (direct current) magnetic flux generated in a magnetic circuit of the magnet 332, the diaphragm 322, and a damper. The diaphragm edge 321 may be laminated on an upper part of the diaphragm 322. The diaphragm edge 321 may have a diaphragm edge vibration part 3212, and a diaphragm edge compression part 3211 extending upward along a corner of the diaphragm edge vibration part 3212. Here, the diaphragm edge compression part 3211 may have one lateral surface opened. Accordingly, a speaker sound generated by the diaphragm 322 may be radiated to the external through the opened lateral surface of the diaphragm edge compression part 3211. For example, if the speaker sound generated by the diaphragm 322 is failed to be radiated to the front through a front housing 31, the generated speaker sound may be radiated in a sound radiation direction (arrow) through the opened one lateral surface of the diaphragm edge compression part 3211. The diaphragm edge compression part 3211 may be fixed with at least a portion of the hollow shape frame 333, and may be adhered and fixed to at least a portion of the front housing 31. A fixing method may use a bond or double-sided tape, but it is not limited to this.

Figure 18:
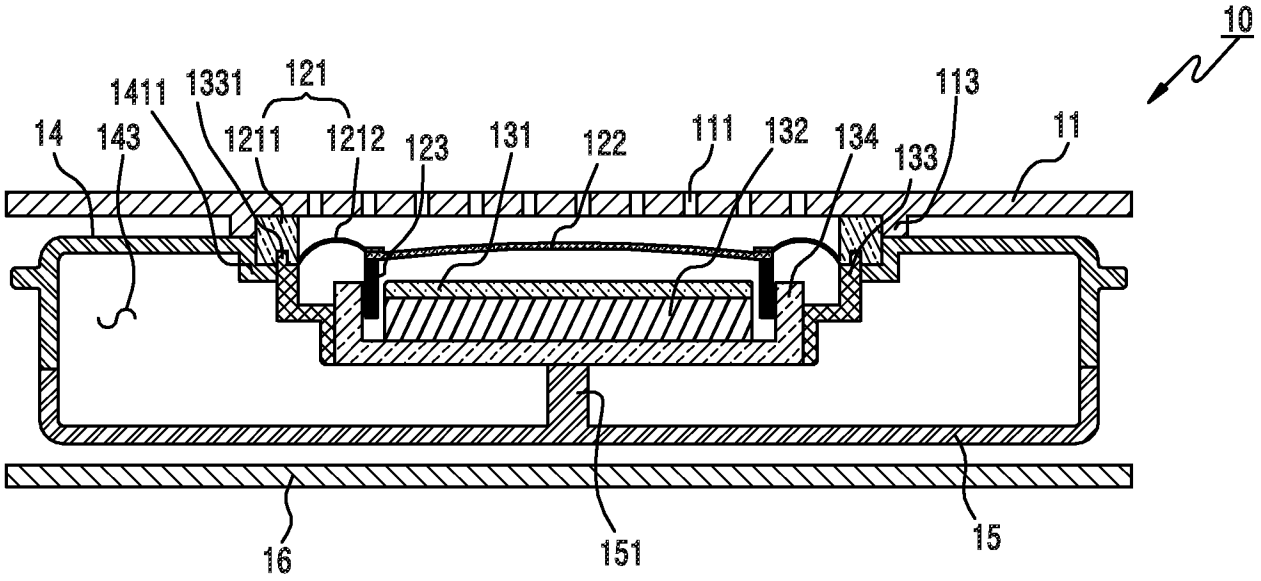
FIG. 18 is a cross section illustrating a coupled state of a speaker apparatus according to various embodiments of the present disclosure.

FIG. 18 is a cross section illustrating a coupled state of a speaker apparatus according to various embodiments of the present disclosure.

Referring to FIG. 18, a front housing 11 of the speaker apparatus 10 may have a plurality of speaker sound radiation holes 111 having a certain opening area and for radiating a speaker sound through the certain opening area). Also, the front housing 11 may have a support rib 113 of a certain shape extended downward. At speaker apparatus 10 assembling, the support rib 113 may play a role of an assembly guide. After speaker apparatus 10 assembling, the support rib 113 may prevent the left/right flowage of the speaker apparatus 10 dependent on vibration. The speaker apparatus 10 may be assembled with an enclosure upper case 14 and enclosure lower case 15 for forming a sound resonance space 143 therein. The enclosure lower case 15 may have a support boss 151 for supporting in a height direction a vibration part and a magnet part safely mounted within the enclosure upper case 14. The enclosure upper case 14 may have a safe mounting part 1411 for safely mounting the aforementioned vibration part and magnet part in its internal space. The safe mounting part 1411 may be protruded from an inner surface of the enclosure upper case 14. The vibration part and the magnet part may be safely mounted in a fixed state on the safe mounting part 1411.

According to an embodiment of the present disclosure, a hollow shape frame 133 having a certain shape may be arranged in an internal part of the enclosure upper case 14. A guide rib 1331 for assembling and fixing to the diaphragm edge 121 may be formed at an upper side of the hollow shape frame 133. The diaphragm edge 121 having a shape corresponding to the guide rib 1331 may be fitted to the guide rib 1331, and may be fixed with a bond, a double-sided tape, etc. A plate type yoke 134 may be installed in an internal space of the hollow shape frame 133, and a magnet 132 and a plate 131 may be sequentially laminated on an upper part of the yoke 134. A diaphragm 122 may be arranged on an upper part of the hollow shape frame 133. A voice coil 123 may be arranged on a lower part of the diaphragm 122 such that the up/down flowage of the voice coil 123 is possible by a non-alternating (direct current) magnetic flux generated in a magnetic circuit of the magnet 132, the diaphragm 122, and a damper. The diaphragm edge 121 may be laminated on an upper part of the diaphragm 122. The diaphragm edge 121 may have a diaphragm edge vibration part 1212, and a diaphragm edge compression part 1211 extending upward along a corner of the diaphragm edge vibration part 1212. The diaphragm edge compression part 1211 includes a recess corresponding to the shape of the aforementioned guide rib 1331, and the guide rib 1331 may be inserted and fixed to this recess. The diaphragm edge compression part 1211 may be fixed with at least a portion of the hollow shape frame 133, and may be adhered and fixed to at least a portion of the front housing 11. A fixing method may use a bond or double-sided tape, but it is not limited to this.

Figure 19:
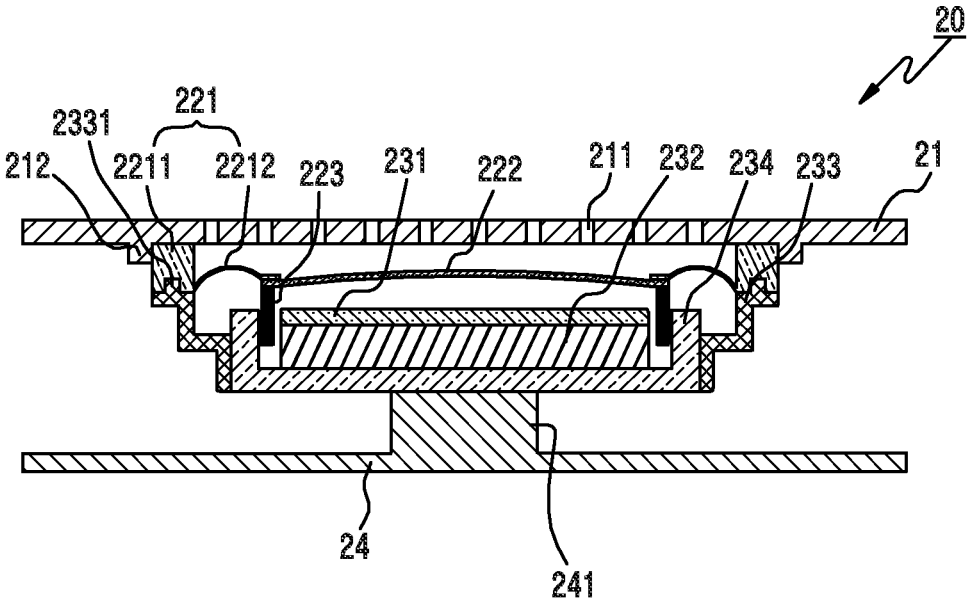
FIG. 19 is a cross section illustrating a coupled state of a speaker apparatus according to various embodiments of the present disclosure.

FIG. 19 is a cross section illustrating a coupled state of a speaker apparatus according to various embodiments of the present disclosure.

Referring to FIG. 19, the speaker apparatus 20 may have a speaker structure not applying an enclosure forming a resonance space.

A front housing 21 of the speaker apparatus 20 may have a plurality of speaker sound radiation holes 211 having a certain opening area and for radiating a speaker sound through the certain opening area. The front housing 21 may have a support rib 212 of a certain shape extended downward. At speaker apparatus 20 assembling, the support rib 212 may play a role of an assembly guide. After speaker apparatus 20 assembling, the support rib 212 may prevent the left/right flowage of the speaker apparatus 20 dependent on vibration. A rear housing 24 may have a support boss 241 for supporting the aforementioned vibration part and magnet part in a height direction.

A hollow shape frame 233 having a certain shape may be arranged at an upper side of a support boss 241. A guide rib 2331 for assembling and fixing to a diaphragm edge 221 may be formed at an upper side of the hollow shape frame 233. The diaphragm edge 221 having a shape corresponding to the guide rib 2331 may be fitted to the guide rib 2331, and may be fixed with a bond, a double-sided tape, etc. A plate type yoke 234 may be installed in an internal space of the hollow shape frame 233, and a magnet 232 and a plate 231 may be sequentially laminated on an upper part of the yoke 234. A diaphragm 222 may be arranged on an upper part of the hollow shape frame 233. A voice coil 223 may be arranged on a lower part of the diaphragm 222 such that the up/down flowage of the voice coil 223 is possible by a non-alternating (direct current) magnetic flux generated in a magnetic circuit of the magnet 232, the diaphragm 222, and a damper. The diaphragm edge 221 may be laminated on an upper part of the diaphragm 222. The diaphragm edge 221 may have a diaphragm edge vibration part 2212, and a diaphragm edge compression part 2211 extending upward along a corner of the diaphragm edge vibration part 2212. The diaphragm edge compression part 2211 includes a recess corresponding to the shape of the aforementioned guide rib 2331, and the guide rib 2331 may be inserted and fixed to this recess. The front housing 21 may be arranged on an upper part of the diaphragm edge compression part 2211, and the diaphragm edge compression part 2211 may come in contact with the support rib 212 formed on a lower surface of the front housing 21. At least a portion of the diaphragm edge compression part 2211 may be fixed with at least a portion of the support rib 212 coming in contact with the front housing 21. A fixing method may use a bond or double-sided tape, but it is not limited to this.

According to various embodiments of the present disclosure, a speaker apparatus may include a hollow shape frame, a magnet arranged in an internal part of the hollow shape frame, a voice coil installed to be in proximity to the magnet, a diaphragm including a diaphragm edge that vibrates by an electric current applied to the voice coil, and a diaphragm edge compression part extended upward along a corner of the diaphragm edge. The diaphragm edge compression part may get in contact with an inner surface of a housing of an electronic device.

The diaphragm edge compression part may be arranged on an upper part of the hollow shape frame.

A bottom surface of the diaphragm edge compression part may have a recess coupling with a portion of the hollow shape frame.

An upper part of the hollow shape frame may have a guide rib fitted into the recess of the diaphragm edge compression part.

A lateral surface of the diaphragm edge compression part may be adhered closely to a support rib formed in the inner surface of the housing of the electronic device.

The speaker apparatus may further include an enclosure upper case, and an enclosure lower case.

The enclosure upper case may accept the hollow shape frame, and be coupled with the enclosure lower case to form a sound resonance space.

An inner surface of the enclosure upper case may have a safe mounting part for safely mounting the hollow shape frame.

An inner surface of the enclosure lower case may have a support boss supporting the hollow shape frame in a height direction.

At least one lateral surface of the diaphragm edge compression part may be opened.

The diaphragm edge and the diaphragm edge compression part may be formed integrally.

According to various embodiments of the present disclosure, the speaker apparatus may be applied to an electronic device. For example, the electronic device may include a housing including a speaker hole, a hollow shape frame arranged in an internal part of the electronic device, and having a hollow portion formed in a position corresponding to the speaker hole, a magnet arranged in an internal part of the hollow shape frame, a voice coil installed to be in proximity to the magnet, a diaphragm including a diaphragm edge that vibrates by an electric current applied to the voice coil, and a diaphragm edge compression part extended upward along a corner of the diaphragm edge. The diaphragm edge compression part may get in contact with an inner surface of the housing.

A speaker apparatus and an electronic device having the same according to various embodiments of the present disclosure may use a diaphragm edge compression part without a sound leakage prevention member, thereby preventing a leakage sound generated in the speaker apparatus, and may locate the speaker apparatus closer to a housing of the electronic device, thereby improve a high-band playback band.

A speaker apparatus and an electronic device having the same according to various embodiments of the present disclosure may guide sound in a desired direction through a diaphragm edge compression part.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A speaker apparatus comprising:

a hollow shape frame;

a magnet disposed in the hollow shape frame;

a voice coil disposed in proximity to the magnet;

a diaphragm installed on one side of the voice coil, the diaphragm configured to vibrate by an electric current applied to the voice coil;

a diaphragm edge disposed in the diaphragm; and a diaphragm edge compression part extended along the diaphragm edge having at least a portion extended upward at a pre-determined height above the diaphragm edge, wherein the diaphragm edge compression part contacts an inner surface of a housing of an electronic device.

2. The speaker apparatus of claim 1, wherein the diaphragm edge compression part is disposed on an upper part of the hollow shape frame.

3. The speaker apparatus of claim 2, wherein a bottom surface of the diaphragm edge compression part has a recess coupling with a portion of the hollow shape frame.

4. The speaker apparatus of claim 3, wherein an upper part of the hollow shape frame has a guide rib fitted into the recess of the diaphragm edge compression part.

5. The speaker apparatus of claim 1, wherein a lateral surface of the diaphragm edge compression part contacts a support rib formed in the inner surface of the housing of the electronic device.

6. The speaker apparatus of claim 5, further comprising:

an enclosure upper case; and an enclosure lower case, wherein the enclosure upper case accepts the hollow shape frame, and is coupled with the enclosure lower case to form a sound resonance space.

7. The speaker apparatus of claim 6, wherein an inner surface of the enclosure upper case has a safe mounting part for safely mounting the hollow shape frame.

8. The speaker apparatus of claim 7, wherein an inner surface of the enclosure lower case has a support boss supporting the hollow shape frame in a height direction.

9. The speaker apparatus of claim 1, wherein at least another portion of the diaphragm edge compression part does not extend upward at the pre-determined height above the diaphragm edge.

10. The speaker apparatus of claim 1, wherein the diaphragm edge and the diaphragm edge compression part are integrally formed.

11. An electronic device comprising:

a housing comprising a speaker hole;

a hollow shape frame disposed in the electronic device, and having a hollow portion formed in a position corresponding to the speaker hole;

a magnet disposed in the hollow shape frame;

a voice coil installed in proximity to the magnet;

a diaphragm installed on one side of the voice coil, the diaphragm configured to vibrate by an electric current applied to the voice coil;

a diaphragm edge disposed in the diaphragm; and a diaphragm edge compression part extended along the diaphragm edge having at least a portion extended upward at a pre-determined height above the diaphragm edge, wherein the diaphragm edge compression part contacts an inner surface of the housing.

12. The electronic device of claim 11, wherein the diaphragm edge compression part is disposed on an upper part of the hollow shape frame.

13. The electronic device of claim 12, wherein a bottom surface of the diaphragm edge compression part has a recess coupling with a portion of the hollow shape frame.

14. The electronic device of claim 13, wherein an upper part of the hollow shape frame has a guide rib fitted into the recess of the diaphragm edge compression part.

15. The electronic device of claim 11, wherein a lateral surface of the diaphragm edge compression part contacts a support rib formed in the inner surface of the housing of the electronic device.

16. The electronic device of claim 15, further comprising:

an enclosure upper case; and an enclosure lower case, wherein the enclosure upper case accepts the hollow shape frame, and is coupled with the enclosure lower case to form a sound resonance space.

17. The electronic device of claim 16, wherein an inner surface of the enclosure upper case has a safe mounting part for safely mounting the hollow shape frame.

18. The electronic device of claim 17, wherein an inner surface of the enclosure lower case has a support boss supporting the hollow shape frame in a height direction.

19. The electronic device of claim 11, wherein at least another portion of the diaphragm edge compression part does not extend upward at the pre-determined height above the diaphragm edge.

20. The electronic device of claim 11, wherein the diaphragm edge and the diaphragm edge compression part are integrally formed.

* * * * *